US005172452A

United States Patent [19]

Brown

[11] Patent Number: 5,172,452

[45] Date of Patent: Dec. 22, 1992

[54] HINGE WITH OPENING OCCUPIED BY AN INTUMESCENT MATERIAL

[75] Inventor: Peter E. Brown, Bridgnorth, Great Britain

[73] Assignee: Jebron Limited, Wednesbury, United Kingdom

[21] Appl. No.: 701,288

[22] Filed: May 16, 1991

[30] Foreign Application Priority Data

May 16, 1990 [GB] United Kingdom ..... 9011014

[51] Int. Cl.[5] ..... E05D 5/02

[52] U.S. Cl. ..... 16/387; 16/385; 16/223; 16/379; 16/392

[58] Field of Search ..... 16/387, 385, 223, 262, 16/378, 379, 390; 252/606

[56] References Cited

U.S. PATENT DOCUMENTS

| | | | |
|---|---|---|---|
| 904,620 | 11/1908 | Kiple | 16/390 |
| 1,132,560 | 3/1915 | Christophel | 16/387 |
| 1,141,171 | 6/1915 | Brownjohn | 16/378 |
| 3,082,474 | 3/1963 | Anderson | 16/392 |
| 3,083,403 | 4/1963 | Van Noord | 16/379 |
| 3,345,679 | 10/1967 | Anderson | 16/392 |
| 4,297,252 | 10/1981 | Caesar et al. | 252/606 |
| 4,543,687 | 10/1985 | Law | 16/387 |
| 5,053,077 | 10/1991 | Crompton | 252/606 |

FOREIGN PATENT DOCUMENTS

| | | | |
|---|---|---|---|
| 0102788 | 3/1984 | European Pat. Off. . | |
| 0341876 | 11/1989 | European Pat. Off. | 252/606 |
| 0381829 | 11/1964 | Switzerland | 16/378 |
| 1121292 | 7/1968 | United Kingdom | 16/392 |
| 2047311 | 11/1980 | United Kingdom | 16/362 |
| 2186794 | 8/1987 | United Kingdom . | |

*Primary Examiner*—Lowell A. Larson
*Assistant Examiner*—Michael J. McKeon
*Attorney, Agent, or Firm*—Webb Burden Ziesenheim & Webb

[57] ABSTRACT

A hinge for use with a fire door has a blade in which there are formed a number of screw holes and a larger opening. The larger opening is filled with an intumescent material.

17 Claims, 2 Drawing Sheets

HINGE WITH OPENING OCCUPIED BY AN INTUMESCENT MATERIAL

BACKGROUND TO THE INVENTION

The present invention relates to a hinge comprising first and second members and a pivot for connecting the members together for relative pivoting about a hinge axis, wherein at least the first of said members includes a plate-like portion and has a plurality of holes through which screws can pass to secure the plate-like portion in face-to-face relation with a structure to which the first member of the hinge is to be fixed. It will be understood that the particular fasteners used to secure the plate-like portion to the structure will be selected according to the nature of that structure. The holes in the plate-like portion may be countersunk. The plate-like portion may be secured in face-to-face relation with a door or with a door frame or other structure defining a doorway to be closed by the door. Generally, the second member also of the hinge will include a plate-like portion but in some cases, for example a soffit hinge, the second member may be other than of plate-like form, for example the second member may be a socket for receiving a pivot.

SUMMARY OF THE INVENTION

According to the invention, the plate-like portion of a hinge of the kind described has at least one opening which is larger than each screw hole. The presence of the opening restricts the path for flow of heat through the first member of the hinge in a direction away from the hinge axis. Restriction of this path is important in the case of fire which raises to a high value the temperature of those parts of the hinge which are immediately adjacent to the hinge axis.

It will be understood that the parts of a butt hinge which are immediately adjacent to the hinge axis, called herein the knuckle, are exposed adjacent to one face of the door and will therefore be heated rapidly by a fire at that face of the door. Known hinges provide a path for the flow of heat along the interface between the door and frame towards the opposite, cold, face of the door. It is recognised that known hinges provide a relative low-resistance path for the transmission of heat past a closed door in the event of fire and thus tend to mitigate the fire and heat-resisting character of the door itself. For example, it is recommended that the members of the hinge should extend from the knuckle a distance which is considerably less than the thickness of the door, so that the hinge will not conduct heat to almost to the cold face of the door. However, restricting the extent of the hinge from the knuckle in this way reduces the mechanical security and strength of the assembly. The fasteners used to secure the hinge to the door and frame must be near to the knuckle. This is particularly disadvantageous when the knuckle is at the hot face of a door subjected to fire.

The opening of a hinge according to the invention is preferably occupied by an intumescent composition.

BRIEF DESCRIPTION OF THE DRAWINGS

Examples of hinges embodying the invention will now be described, with reference to the accompanying drawings, wherein.

DETAILED DESCRIPTION

Figure 1:
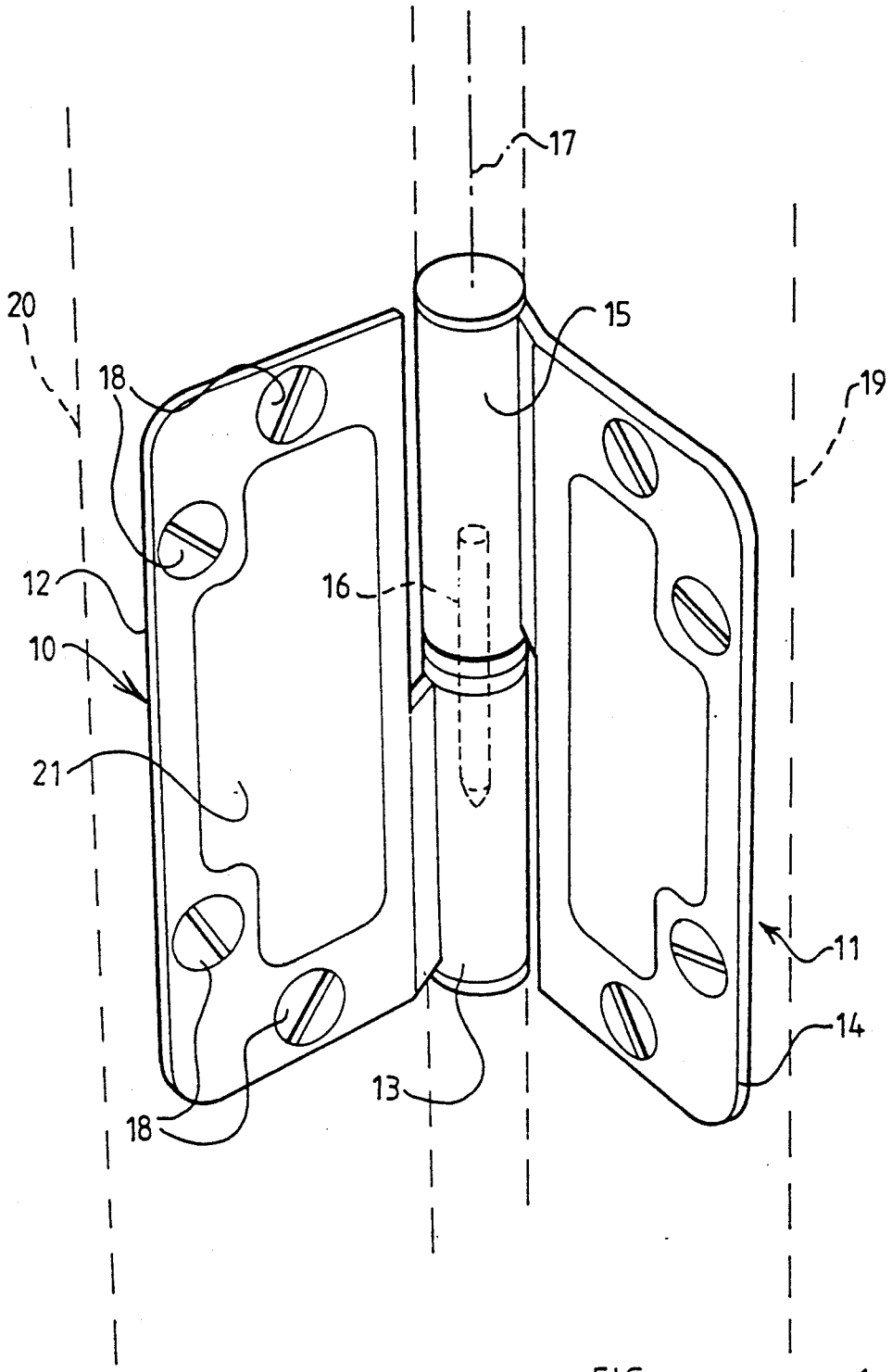
FIG. 1 shows a perspective view of a lift-off hinge, together with parts of an associated door and door frame.

The hinge illustrated in FIG. 1 comprises first and second members 10 and 11 which may be identical with each other. The member 10 comprises a generally flat blade 12 and a knuckle 13 at one margin of the blade. The member 11 comprises a substantially flat blade 14 and a knuckle 15 at one margin of the blade 14. The knuckles 13 and 15 are hollow, substantially cylindrical and collective form a housing for a pivot pin 16 which connects the members 10 and 11 together for relative pivoting about a hinge axis 17. In the particular example illustrated, the pivot pin is fixed in the knuckle 15 and freely slidable in the knuckle 13 so that the members of the hinge can be separated from one another and reassembled repeatedly. The length of each knuckle, that is the dimension measured along the axis 17, is approximately one half of the overall length of the hinge. There may be interposed between the knuckles 13 and 15 a bearing bush. Each knuckle is typically formed integrally with the corresponding blade.

Each of the blades 12 and 14 is generally rectangular and has a length substantially equal to the overall length of the hinge. In each blade, there is formed a number of holes for receiving respective screws 18 for fixing the members 10 and 11 to respective ones of a door and door frame. In the example illustrated, the door is represented at 19 and the member 10 of the hinge is secured an edge face of the door. A recess for receiving the blade 12 may be formed in the edge of the door. The frame of a doorway to be closed by the door 19 is represented at 20 and the blade 14 is secured to the frame in face-to-face relation therewith. It will be understood that means other than the screws 18 may be used to attach the member 11 of the hinge to the door frame 20. In the particular example illustrated, there are four screw holes formed in each blade and four screws associated with that blade.

There is also formed in the blade 12 an opening 21 additional to the screw holes. The opening is considerably larger than the screw holes. Thus, the area of then opening 21 is a plurality of times greater than the area of each screw hole and a plurality of times greater than the aggregate area of the screw holes in the blade 12. Furthermore, that dimension of the opening 21 which extends along the axis 17 is a plurality of times greater than the diameter of the screw holes and is a plurality of times greater than the aggregate of the diameters of the screw holes in the blade 12. That dimension of the opening 21 which extends in a direction at right angles to the axis 17 also is a plurality of times greater than the diameter of each screw hole. The opening 21 extends completely through the thickness of the blade 12 and the blade forms a closed loop around the periphery of the opening 21. Each of the screw holes is spaced from the opening 21 by a portion of the blade 12.

The blade 12 is formed of metal and is therefore a relatively good conductor of heat. In the event of the knuckle 13 being subjected to fire at a first face of the door, the blade 12 will transmit heat from the knuckle towards a second face of the door. The presence of the opening 21 in the blade 12 considerably restricts the path along which heat can flow from the knuckle towards the second face of the door. It will be appreciated that the blade 12 is a relatively poor conductor of heat in this direction, as compared with a blade of similar overall dimensions which is pierced by the screw holes only and defines no other opening. In addition to restricting the flow of heat to the second face of the door, the presence of the opening 21 also restricts the flow of heat to those parts of the door in which the screws 18 are embedded. This improves the ability of the entire structure to retain adequate strength when subjected to fire at the side of the door at which the knuckles of the hinge are exposed.

The particular example of blade shown at 12 in FIG. 1 has a single opening 21. One or more further openings additional to the screw holes may be formed in the blade. The size and the shape of the opening 21 may be varied to preserve the required strength of the blade, whilst maximising the overall resistance of the blade to flow of heat away from the knuckle 13 which is consistent with adequate strength of the hinge. The size and shape of the opening or openings in the blade 12 are selected according to the sizes and positions of the screw holes so that each screw hole is surrounded completely by the metal of which the blade 12 is formed and there is sufficient strength between the respective seats for the screws 18 and the knuckle 13.

In the blade 12, there is a first pair of screw holes near to one end of the blade and a second pair of screw holes near to an opposite end of the blade. This arrangement of holes is well suited to the presence of a single opening 21 lying between the pairs of screw holes. In a case where the screw holes are distributed more evenly along the length of the blade, there may be two or more openings corresponding to the opening 21 and the blade may include a portion lying mid-way between opposite ends of the blade and extending at right angles to the axis 17 across the entire width of the blade. The opening 21 is non-circular and corresponding openings formed in different blades also will generally be non-circular. Thus, the opening 21 has a rectilinear margin parallel to the axis 17 and having a length exceeding one half of the length of the blade.

The opening 21 is preferably filled with an intumescent composition at the time when the hinge is manufactured and before transport of the hinge to a site at which it is fixed to a door. Retaining means may be provided for retaining the intumescent composition in the opening 21. For example rebates may be formed in the blade 12 at margins of the opening so that an interfitting relation which resists movement of the intumescent material out of the opening 21 is established. Alternatively, there may be provided retaining means which extends across the opening 21. For example, a layer of sheet material may be applied to a rear face of the blade 12 and the corresponding face of the intumescent material. This sheet material may be adhered to both the blade and the intumescent material. In a further alternative arrangement, there may be provided filaments which are attached to the blade 12 and extend across the opening 21. These filaments may lie at a face of the intumescent material or be embedded in the intumescent material to restrain movement of that material from the opening 21.

It will beunderstood that, in the event of fire, the intumescent material expands to close the gap between the door 19 and the frame 12 in the vicinity of the hinge and thereby contribute further to retarding the transfer of heat from the first face of the door to the second face of the door.

It has been recommend that the width of the blades of hinges used on fire doors should be considerably less than the thickness of the door, in order that the hinge will not effectively transmit heat from one face of the door to the other. Since a hinge embodying the present invention is a relatively poor conductor of heat, as compared with known hinges, the width of the blade can be relatively greater. According, when a hinge as shown in FIG. 1 is combined with a door, the width of the blade 12 is generally more than one half of the thickness of the door, and is preferably at least two thirds of the thickness of the door. It will be appreciated that a wider hinge blade allows the screws to be positioned further from that face of the door at which the knuckle of the hinge lies and this contributes to the strength of the assembly and particularly to the structural integrity of the assembly when subjected to fire. Even in a fire door, the blade 12 may approach that face of the door which is remote from the knuckle 13 to a distance which is less than one sixth of the thickness of the door.

It will be appreciated that, whilst, for the purpose of illustration, we have shown in FIG. 1 and described a lift-off hinge, the invention may be applied in a substantially similar manner to a butt hinge where at least one leaf has more than one knuckle for receiving the pivot pin.

Figure 2:
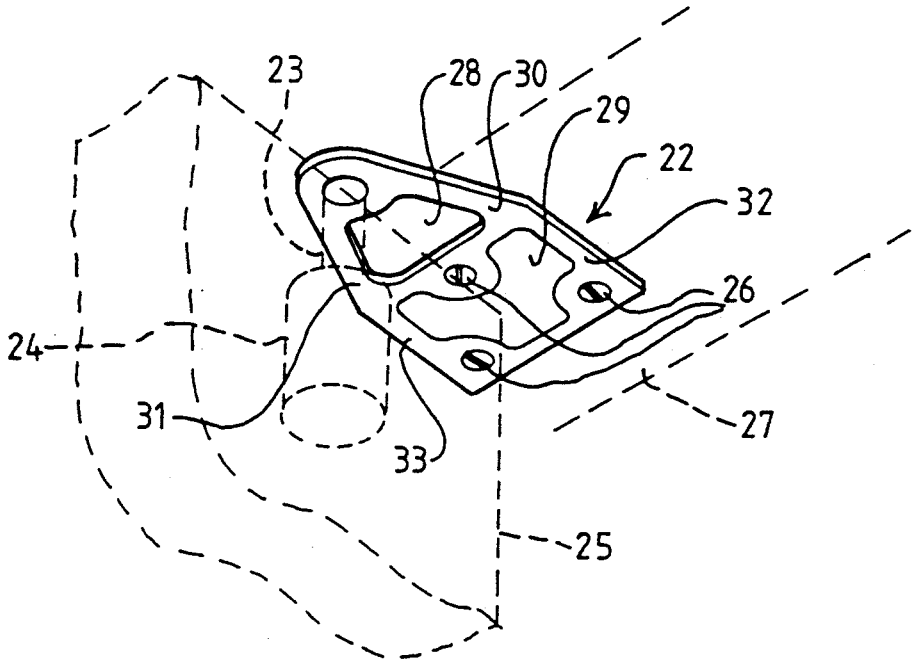
FIG. 2 illustrates a soffit hinge, together with adjacent parts of a door and of a door frame.

A further example of a hinge to which the invention has been applied is illustrated in FIG. 2. The hinge of FIG. 2 is a soffit hinge comprising a plate-like member 22 which is secured by screws to the soffit of a frame defining doorway. The member 22 carries a pivot pin 23 which extends into a socket 24 provided in an upper end portion of a door 25, adjacent to an edge of the door. In the example illustrated in FIG. 2, there are three screw holes containing respective screws 26 which secure the plate 22 to the frame 27.

There is also formed in the plate-like member 22 non-circular openings 28 and 29. The member 22 forms a closed loop around each of the openings 28 and 29.

The opening 28 lies between the pivot pin 23 and the screw holes and has an area considerably greater than that of each screw hole. That portion of the member 22 which contains the screw holes is connected with the pivot pin 23 only by a pair of limbs 30 and 31 which lie at opposite sides of the opening 28 and each of which is narrow, as compared with the opening. In the example illustrated, each of the limbs 30 and 31 is rectilinear.

The opening 29 lies between the screw holes and also has an area which is considerably greater than the area of each screw hole. The area of the opening 29 preferably exceeds the aggregate area of the screw holes.

The member 22 comprises a further pair of rectilinear limbs 32 and 33 which lie at opposite sides of the opening 29. It will be noted that heat which is conducted from the pivot pin 23 to a margin of the member 22 remote from the pivot pin must pass along one or other of the limbs 30 and 31 and must also pass along one or other of the limbs 32 and 33. The limbs 32 and 33 also are narrow, relative to the opening 28 and relative to the opening 29.

One or both of the openings 28 and 29 may be filled an intumescent material and retaining means similar to that hereinbefore described may be provided for retaining intumescent material in these openings. Both in the case of the hinge shown in FIG. 2 and in the case of the hinge shown in FIG. 1, the intumescent may be introduced into the openings concerned through an array of filaments which will then retain the intumescent material within the opening concerned. It will be understood that an extrudable intumescent composition is commonly used. The intumescent materials used in hinges embodying the present invention may be a known intumescent composition used in association with building components such as doors and frame.

It will be noted that the intumescent material is conveniently applied to the hinges when the hinges are manufactured and that the hinges can then be stored, transported and fitted with the intumescent material remaining in the hinges. Preferably, the intumescent material lies only within the thickness of members of the hinge and does not overlap with members of the hinge.

The features disclosed in the foregoing description, or the following claims, or the accompanying drawings, expressed in their specific forms or in the terms of means for performing the desired function, may, separately or in any combination of such features, be utilised for realising the invention in diverse forms thereof.

I claim:

1. A butt hinge comprising first and second members and a pivot for connecting the members for relative pivoting about an axis of the hinge, wherein at least the first of said members includes a plate-like portion and has a plurality of holes through which screws can pass to secure the plate-like portion in face-to-face relation with a structure to which the first member of the hinge is to be fixed, characterized in that the plate-like portion has at least one opening which is of larger area than each said screw hole and which opening is occupied by an intumescent material.

2. A hinge according to claim 1 wherein the area of said opening is a plurality of times greater than the aggregate area of said holes in the first member.

3. A hinge according to claim 1 wherein said opening lies between the hinge axis and at least one of said holes.

4. A hinge according to claim 1 wherein the intumescent composition completely fills the opening.

5. A hinge according to claim 1 wherein said first member forms a closed loop around the opening.

6. A hinge according to claim 1 wherein there is in said first member a further opening which is also larger than the screw holes.

7. A hinge according to claim 1 wherein said opening extends over at least one half of the width of said first member, measured from the hinge axis to an edge of the first member remote from the hinge axis.

8. In combination, a structure defining a doorway, a door for closing the doorway, and a plurality of hinges connecting the door with said structure for pivoting relative to the structure, wherein at least one of said hinges is a butt hinge as defined in claim 1 and is interposed between an edge of the door and said structure.

9. A combination according to claim 8 wherein the first member of said one hinge extends across more than two thirds of the thickness of the door.

10. A combination according to claim 8 wherein the area of said opening is a plurality of times greater than the aggregate area of said holes in the first member.

11. A combination according to claim 8 wherein said opening lies between the hinge axis and at least one of said holes.

12. A soffit hinge comprising first and second members and a pivot for connecting the members for relative pivoting about an axis of the hinge, wherein the first of said members is a plate which, in use, is fixed to a head of a frame defining a doorway and has a plurality of holes through which screws can pass to secure the plate-like portion in face-to-face relation with the head characterized in that the plate has at least one opening which is of larger area than each said screw hole and in that said opening is occupied an intumescent material.

13. A soffit hinge according to claim 12 wherein the area of said opening is a plurality of times greater than the aggregate area of said holes in the first member.

14. A soffit hinge according to claim 12 wherein said opening lies between the hinge axis and at least one of said holes.

15. In combination, a structure defining a doorway and including a soffit, a door for closing the doorway and a plurality of hinges connecting the door with said structure for pivoting relative to the structure, wherein one of said hinges is a soffit hinge as defined in claim 6 and wherein said first member is fixed to the soffit and lies between the soffit and the door when the door is closed.

16. A combination according to claim 15 wherein the area of said opening is a plurality of times greater than the aggregate area of said holes in the first member.

17. A combination according to claim 16 wherein said opening lies between the hinge axis and at least one of said holes.

* * * * *

UNITED STATES PATENT AND TRADEMARK OFFICE

CERTIFICATE OF CORRECTION

PATENT NO. : 5,172,452

DATED : December 22, 1992

INVENTOR(S) : Peter E. Brown

It is certified that error appears in the above-identified patent and that said Letters Patent is hereby corrected as shown below:

Column 3 Line 61 "beunderstood" should read --be understood--.

Column 3 Line 67 "recommend" should read --recommended--.

Column 4 Line 59 after "filled" insert --with--.

Claim 12 Line 25 Column 6 after "occupied" insert --by--.

Signed and Sealed this

Sixteenth Day of November, 1993

*Attest:*

*Attesting Officer*

BRUCE LEHMAN

*Commissioner of Patents and Trademarks*